US007695420B2

(12) United States Patent
Gelli et al.

(10) Patent No.: US 7,695,420 B2
(45) Date of Patent: Apr. 13, 2010

(54) MACHINE FOR PRODUCING TUBULAR PRODUCTS WITH A CUTTER CARRIED BY A ROTATING ARM AND RELATIVE PRODUCTION METHOD

(75) Inventors: Mauro Gelli, Lucca (IT); Mario Gioni Chiocchetti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 664 days.

(21) Appl. No.: 10/556,587

(22) PCT Filed: May 24, 2004

(86) PCT No.: PCT/IT2004/000297

§ 371 (c)(1),
(2), (4) Date: Nov. 30, 2005

(87) PCT Pub. No.: WO2004/106017

PCT Pub. Date: Dec. 9, 2004

(65) Prior Publication Data

US 2006/0288558 A1 Dec. 28, 2006

(30) Foreign Application Priority Data

May 30, 2003 (IT) ..... FI2003A0155

(51) Int. Cl.
*B31C 11/04* (2006.01)

(52) U.S. Cl. ..... 493/276; 493/299; 493/288; 83/54

(58) Field of Classification Search ..... 493/276, 493/290, 299, 288, 269, 278, 287; 83/54, 83/318, 320, 319
See application file for complete search history.

(56) References Cited

U.S. PATENT DOCUMENTS

| | | | | |
|---|---|---|---|---|
| 2,699,099 | A * | 1/1955 | Robinson | 493/11 |
| 3,133,483 | A * | 5/1964 | Glasby | 493/290 |
| 3,150,575 | A | 9/1964 | Couzens et al. | |
| 3,220,320 | A | 11/1965 | Brigham | |
| 3,636,827 | A | 1/1972 | Lindberg | |
| 3,942,418 | A | 3/1976 | Smith | |
| 4,370,140 | A | 1/1983 | Fegley et al. | |
| 4,378,966 | A | 4/1983 | Schumacher | |
| 4,756,217 | A * | 7/1988 | Holmes | 82/53.1 |
| 4,934,227 | A * | 6/1990 | Knorr | 82/173 |
| 5,468,207 | A | 11/1995 | Bower et al. | |
| 5,873,806 | A | 2/1999 | Biagiotti | |
| 2006/0124435 | A1 * | 6/2006 | Benvenuti et al. | 198/626.1 |
| 2006/0162522 | A1 * | 7/2006 | Chiocchetti et al. | 83/471 |
| 2007/0095967 | A1 * | 5/2007 | Biagiotti et al. | 242/526 |
| 2007/0264461 | A1 * | 11/2007 | Gelli | 428/43 |
| 2008/0009399 | A1 * | 1/2008 | Gelli et al. | 493/272 |

FOREIGN PATENT DOCUMENTS

| | | |
|---|---|---|
| AU | 30210/67 | 5/1970 |
| DE | 1 956 274 | 12/1971 |

* cited by examiner

*Primary Examiner*—Sameh H. Tawfik
(74) *Attorney, Agent, or Firm*—Breiner & Breiner, LLC

(57) ABSTRACT

The machine comprises a mandrel (4), a winding member (7) to helically wind said strips of web material about said mandrel and form a continuous tube; and rotating disk-shaped cutter (25), cooperating with said mandrel (4), to cut the continuous tube (T) into individual tubular products (M). The disk-shaped cutter (25) is carried by a rotating arm (23).

16 Claims, 3 Drawing Sheets

28
T
fT
4
4
M
D
30
f23
27
25
25
C
29
23
21
B

MACHINE FOR PRODUCING TUBULAR PRODUCTS WITH A CUTTER CARRIED BY A ROTATING ARM AND RELATIVE PRODUCTION METHOD

TECHNICAL FIELD

The present invention relates to a corewinder, that is, a machine or device used to produce tubular products from strips of web material wound helically about a mandrel and glued to form the finished product.

The invention also relates to a method for producing tubular products of the aforesaid type.

STATE OF THE ART

In the production of rolls of web material, for example rolls of toilet paper, rolls of kitchen towel, rolls of non-woven fabric, rolls of adhesive tape, plastic film, metalized film or the like, tubes of cardboard or another material are commonly utilized as winding cores, obtained by overlapped and staggered winding of at least two strips of web material bonded together. Winding is performed by machines called corewinders, which have a forming mandrel (fixed or supported idle about its axis) about which strips of web material previously provided with a layer of glue are wound. In practice, the glue is applied to one of the two faces of every strip except one. Winding is obtained by means of a winding member, typically a continuous belt, which forms a helical turn about the mandrel and causes the strips of web material to be drawn and wound, and also exerts the pressure required for bonding.

Examples of machines of this type are described in U.S. Pat. Nos. 3,150,575; 3,220,320; 3,636,827; 3,942,418; 4,378,966; 4,370,140; 5,468,207; 5,873,806.

The strips of web material are wound continuously and form a continuous tube which is then cut into sections of the required length by means of cutting members disposed along the extension of the forming mandrel or at the end thereof. Devices of various types have been produced to cut the continuous tube into individual sections. These must be reliable, perform accurate cutting and allow high production speeds to be reached. The U.S. Pat. No. 5,873,806 relates in particular to a cutting device for corewinders, wherein a pair of rotating cutters are brought into contact with pressure against the tube to be cut or, alternatively, withdrawn. When in the cutting position they are made to advance at the same speed as the tube being formed and a particular kinematic system is used to rotate the cutters taking motion from the same motion as the carriage carrying the cutters, which translates forwards and backwards.

This cutting device is particularly efficient and allows considerable production speeds to be reached. Nonetheless, it is complex and relatively expensive. Moreover, it does not allow high speeds to be reached due to the inertial forces and the vibrations produced as a result of the alternate motion supplied to the carriage carrying the cutters.

OBJECTS AND SUMMARY OF THE INVENTION

The object of the present invention is to produce a machine to produce tubular products, with a cutting device of the continuous tube being formed that is economical and reliable and that improves the performance of the machine.

The object of a preferred embodiment of the present invention is to produce a machine wherein the cutting device does not have the problems deriving from the inertial stresses produced by the alternate movements.

Essentially, according to the invention a machine to produce tubular products through helically winding strips of web material (so called corewinder), is provided with a disk-shaped cutter carried by a rotating arm, which makes the cutter follow a trajectory that interferes with the tube being formed around the mandrel of the machine, so that during a portion of the rotatory travel of the arm the cutter cuts the tube.

Within the scope of the present description and of the appended claims, the disk-shaped cutter is understood to be any disk-shaped member that acts on the cardboard to produce the cut. This may be an actual cutter, with a smooth or preferably serrated cutting edge. Nonetheless, it may also be a grinding wheel or an abrasive disk, which in this context carries out the function of a cutter.

In the present description and in the appended claims, unless otherwise specified, rotatory motion is intended both as a movement always in the same direction of rotation, without reversal, and as an alternate or oscillating rotatory motion, that is, with reversal of the direction of rotation. Analogously, unless otherwise specified, rotating arm must be generically intended as an arm rotating always in the same direction, or also as a mobile arm with alternate, that is oscillating, rotatory motion.

The rotatory motion always in the same direction and preferably continuous, that is without stops, makes it possible to obtain the further advantage of decreasing stresses to eliminate or greatly reduce the inertial forces and resulting vibrations in the machine.

Thanks to the limited number of elements and moving parts, the cutting device is particularly simple.

When movement is rotatory without reversal of the direction of rotation, it is generally continuous, although not at constant speed. This allows the machine to be adapted to different lengths of the tubular product to be produced. Indeed, the arm is made to rotate so that the advance speed of the cutter is essentially approximately equal to the advance speed of the tube being formed around the mandrel for the time during which the cutter is engaged in the tube to be cut. During the remaining part of rotation the arm may be accelerated or decelerated (even stopped briefly) to allow the tubular material being formed to advance for the required length between one cut and the next.

According to a particularly advantageous embodiment of the invention the arm carrying the cutter rotates about an axis that is skew with respect to the axis of the mandrel around which the strips forming the tubular product are wound and positioned at 90° with respect thereto.

Although in theory it is possible also to provide more than one rotation arm and more than one cutter, to obtain a particularly simple machine, it is advantageous to use a single arm with a single cutter. In this case the trajectory of the cutter with respect to the continuous tube formed about the mandrel is such that the cutter engages the tube for an arc of rotation of the arm, during which the tube performs at least one complete rotation about the axis of the mandrel. In this way a single cutter performs the entire cut of the tube.

As shall be explained hereunder, with reference to the examples of embodiment, the cutter may be carried by the rotating arm so that it assumes with its axis a fixed position with respect to the arm. In this case the axis of the disk-shaped cutter will not be exactly parallel to the axis of the mandrel and therefore of the tube to be cut for the entire cutting arc. Nonetheless, if the arm carrying the cutter is sufficiently long, the variation in the direction of the axis of rotation of the cutter with respect to the axis of the mandrel is limited and acceptable. In particular, it is possible for this variation to be no greater than +/−8-10°. In a slightly more complex although more accurate embodiment, the cutter may assume a variable position with respect to the rotating arm carrying it, so that its axis of rotation remains parallel to the axis of the mandrel for the entire time or for the majority of the time during which the cutter is in contact with the tube to be cut. Alternatively, the position of the mandrel may be controlled to reduce the error in parallelism between the axes without necessarily providing an accurate parallelism.

For this purpose it is possible, for example, for the cutter to be carried by a support oscillating or rotating about an axis carried by the rotating arm and parallel to the axis of rotation of said arm.

In principle, the cutter may be supported idle about its axis, and may be drawn by friction with the material forming the tube to be cut. Nonetheless, to obtain a more reliable cut it is preferable for the cutter to be motorized, for example by means of a pneumatic motor, which may be fed with compressed air supplied to the rotating arm by means of a rotating distributor. The cutter may have a smooth circular blade. Nonetheless, in a preferred embodiment, the cutting edge of the cutter is toothed or serrated. In this case it may be advantageous to provide a system for suction of the shavings or dusts which are formed during the cut.

Further advantageous characteristics and embodiments of the machine according to the invention shall be described hereunder and are indicated in the appended dependent claims.

According to a different aspect, the invention relates to a method for producing tubular products, wherein:

- strips of web material are wound helically about a winding mandrel, to form a tube in continuous mode;
- the tube is divided into sections to form said tubular products, by means of at least one rotating disk-shaped cutter that comes into contact with said tube and advances with it along the mandrel during the cut.

Characteristically, according to the invention, the cutter is made to advance along the path of the tube to be cut by making it rotate on a rotating arm about an axis not parallel to the axis of the mandrel.

Further advantageous characteristics of the method according to the invention shall be described hereunder and are indicated in the dependent claims.

BRIEF DESCRIPTION OF THE DRAWINGS

The invention shall be better understood with reference to the description hereunder and to the accompanying drawings, showing a non-limiting practical embodiment of the invention. In the drawing, where equivalent or corresponding parts are indicated with the same reference numerals.

DETAILED DESCRIPTION OF THE PREFERRED EMBODIMENTS OF THE INVENTION

Figure 1:
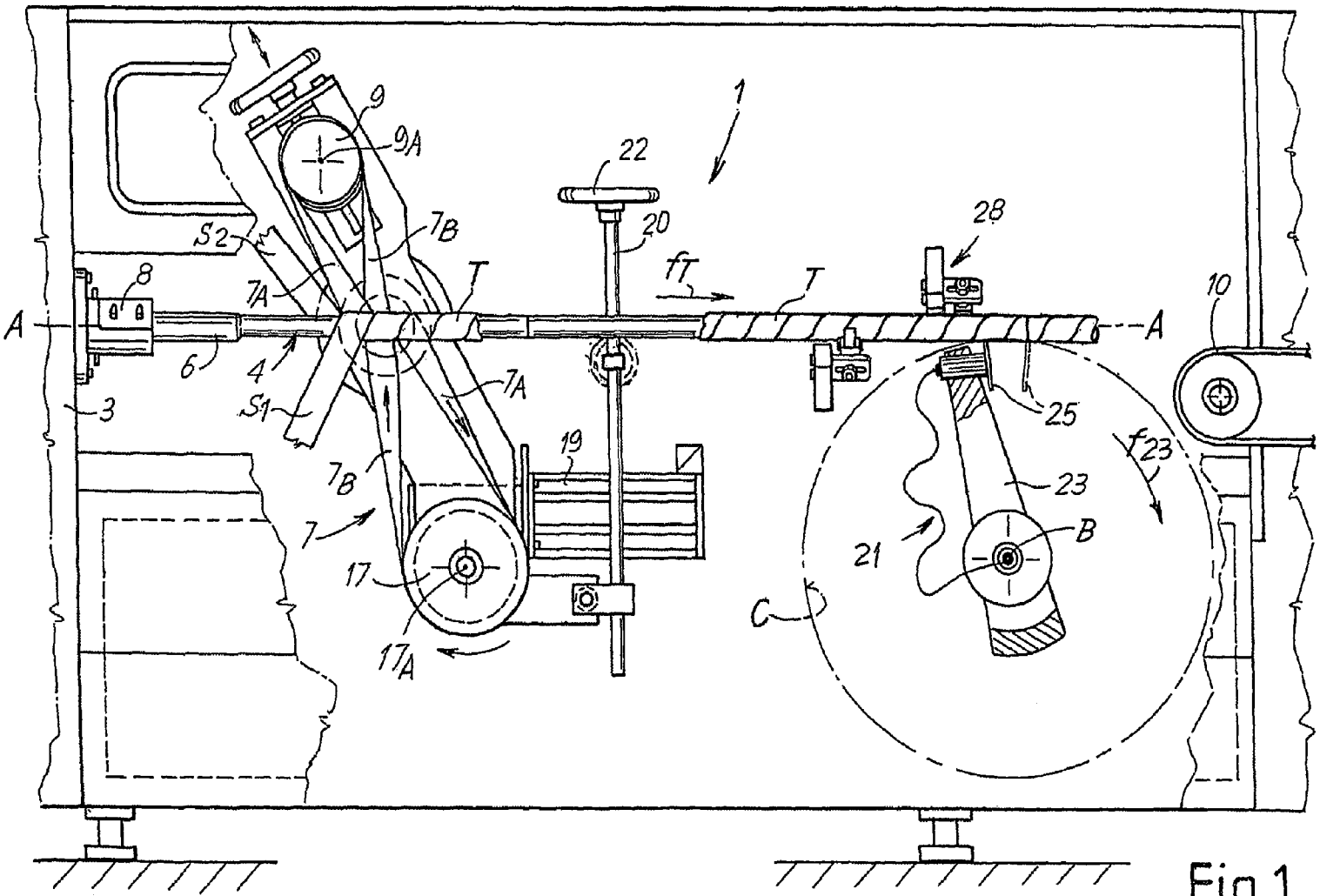
FIG. 1 shows a side view of a corewinder according to the invention in a first embodiment.

FIG. 1 shows as a whole a possible embodiment of a corewinder to which the present invention is applied. It must however be understood that the invention may also be applied to machines with a different structure, as long as they are provided with a forming mandrel to form tubes, which may be fixed or rotating about its axis, and which require a cutting device to cut the tube formed continuously about the mandrel into sections or tubular products.

Briefly, and limited to the parts of interest for the present description, the machine in FIG. 1, indicated as a whole by 1, comprises a load-bearing structure 3 from which a mandrel 4 is supported in a cantilever fashion, a first end thereof being constrained to the load-bearing structure 3 by means of a sleeve 8. The opposite end of the mandrel 4 terminates in proximity to the area in which the tube is cut. A conveyor belt 10 or the like then removes the individual tubular products obtained from cutting a tube T, formed continuously as described hereunder about the mandrel 4.

To form the tube T, continuous strips of cardboard or of another continuous web material are fed to the corewinder 1. In the example shown two strips indicated with S1 and S2 are employed. These are wound helically about the mandrel 4 with the aid of a continuous belt 7 which has two branches 7A and 7B, driven about two pulleys 9 and 17, of which 9A and 17A indicate the respective axes of rotation. The branch 7A forms a helical turn about the mandrel 4 and about the strips of web material S1 and S2 being wound. The numeral 19 indicates the motor which draws the driving pulley 17 in rotation, causing movement of the belt 7.

Inclination of the assembly formed of the pulleys 9, 17, of the belt 7 and of the motor 19 is adjustable by means of a threaded bar 20 and a handwheel 22, so as to adjust inclination of the helical turns formed by the two strips S1, S2 about the axis of the mandrel 4.

The two strips S1 and S2 are wound overlapping and staggered, so that a helix formed by the turns of the outermost strip S1 overlaps, for example, by being staggered by half a pitch, a helix formed by the turns of the innermost strip S2.

A glue is applied to the inner surface of the outer strip S1 and/or to the outer surface of the inner strip S2 in a way per se known and not shown, to make the two turns adhere to each other.

The tube T is produced continuously and must therefore be cut into sections of the required length. For this purpose, a cutting device, indicated as a whole with 21, is provided downstream of the winding system 7, 9, 17, 19 with respect to the direction of feed fT of the tube along the forming mandrel 4.

Figure 2:
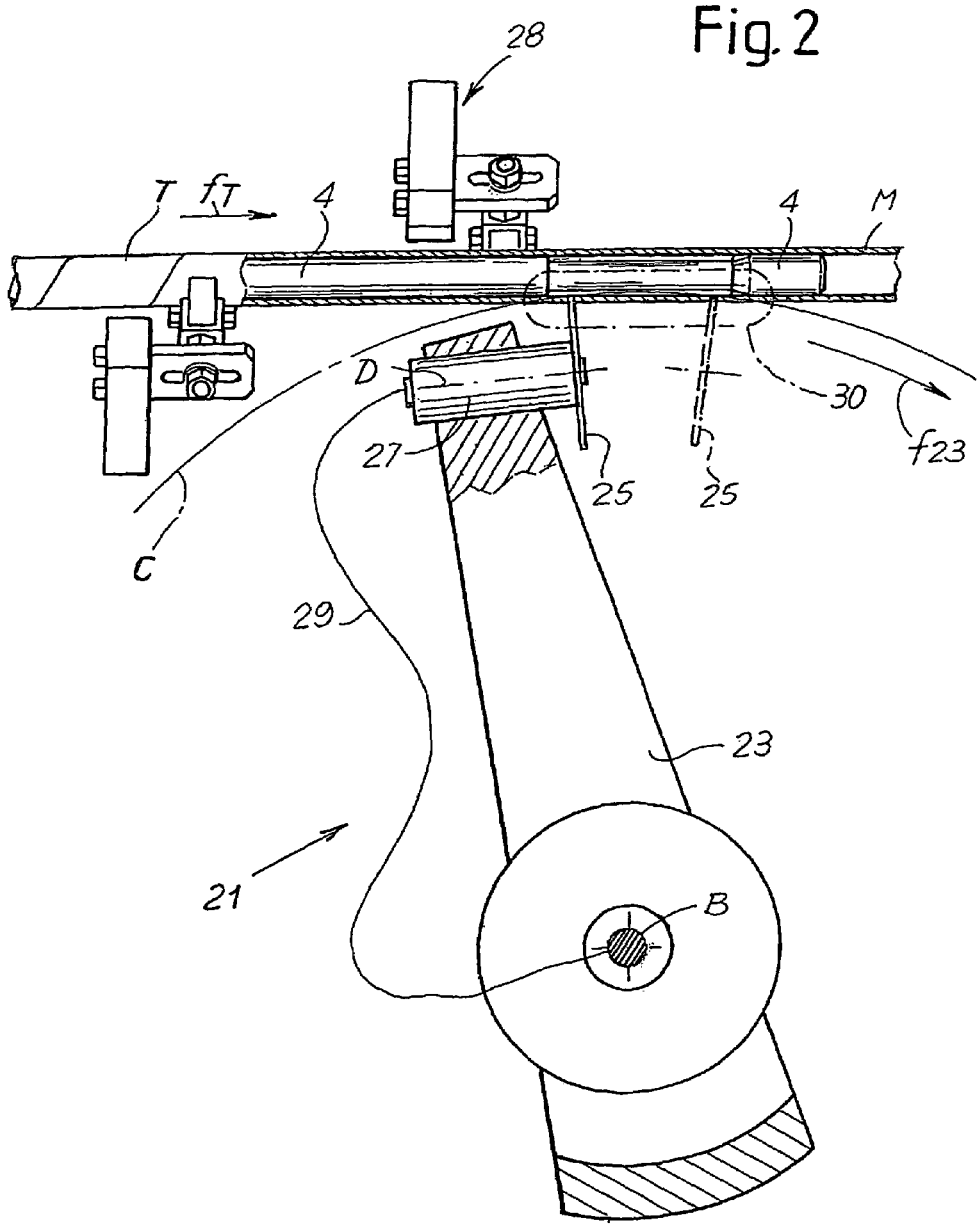
FIG. 2 shows an enlarged detail of the cutting area of the tube.

The cutting device 21, shown in detail also in FIG. 2, comprises an arm 23 rotating about an axis B positioned at 90° with respect to the axis A of the mandrel 4 and skew with respect thereto. The direction of rotation (clockwise in the drawing) of the arm 23 is indicated with f23. At the distal end, that is the end away from the axis of rotation B, the arm 23 carries a disk-shaped cutter 25 motorized by a motor 27. In the example shown the motor 27 is a pneumatic motor, fed by a compressed air duct, indicated schematically with 29, which receives the compressed air through a rotating distributor, not shown in detail.

In the Figure the cutting device 21 is located under the mandrel 4. Nonetheless, it must be understood that it may be located in any suitable position with respect to the axis of the mandrel, also as a function of the requirements for space.

The cutter 25 rotates about its axis D (FIG. 2) which, in the example in FIGS. 1 and 2, assumes a fixed position with respect to the arm 25. In this way when the arm 25 rotates about the axis B, the point of the blade of the cutter 25 farthermost from the axis of rotation B of the arm 25 travels along a circumference C that intersects in two points the external surface of the tube T being formed on the mandrel 4, as can be seen in particular in FIG. 2. For the entire arc of rotation of the arm 25 between the positions corresponding to the points of intersection between the circumference C and the cylindrical surface of the tube T the cutter 25 is in contact with said tube and performs cutting.

In FIG. 2 the arm 23 is shown in the angular position corresponding to the start of cutting of the tube T, that is in the first position wherein the circumference C intersects the cylindrical surface of the tube T. The position of the cutter in the point wherein the circumference C intersects the cylindrical outer surface of the tube T for the second time is shown with 25X. After moving beyond this position the cutter 25 is no longer in contact with the tube.

Complete cutting of the tube T must be performed between these two positions of the cutter to obtain the single section or final tubular product M, which is removed by the conveyor 10. To obtain complete cutting, the tube T must carry out a complete rotation about its axis during the time wherein the cutter 25 is in contact with it. In actual fact, not all the arc of rotation between the two end positions of the cutter shown in FIG. 2 is available for cutting. In fact, to obtain complete cutting a complete rotation of the tube must take place with the cutter inserted in the material forming the tube T for the entire thickness thereof. Therefore, the tube T will perform a rotation exceeding 360° while the cutter 25 will pass from one to the other of the positions shown in FIG. 2.

To allow the cutter to penetrate the cylindrical wall forming the tube T without deforming said tube it may be suitable for the mandrel 4 to extend inside the tube in the area of action of the cutter, as shown in FIG. 2, although in principle a shorter mandrel 4, which does not reach the cutting area, may be used. This can, for example, be provided when the material of the tube is sufficiently stiff and/or when the mechanical characteristics of the cutter allow easy penetration in said material.

In the example shown, the mandrel 4 is provided with a decreased area at the level of the area of action of the cutter, that is, a portion in which the cross section of the mandrel is smaller with respect to the internal section of the tube. For example, the mandrel may be provided with a ground part on the side from which the cutter penetrates the material. In this case the mandrel must not be rotating. Alternatively, as shown in the drawing, the mandrel may have a circular section with a smaller diameter. This solution may be adopted both with a rotating mandrel and with a fixed mandrel.

The tubular product M obtained from the cut performed by the cutter 25 is removed by the conveyor 10, through the effect of the speed of said conveyor, which is greater than the speed at which the tube T is formed.

To contrast the stress of the cutter 25 during cutting, as shown in the example in the drawing, a rest 28 may be provided, constituted by a pair of idle rollers, inclined by an angle approximately equal to the angle of the helix formed by the strips S1, S2, and acting on the tube T on the opposite side with respect to the cutter 25.

If the cutter 25 has a toothed or serrated blade, as will be preferable to obtain a more efficient cut, it is advisable to provide a suction outlet or another means to remove dusts and shavings in the cutting area. This is schematically indicated in FIG. 2 with a dashed line 30. The outlet has an elongated form so that suction is performed along the entire area of action of the cutter 25. More than one outlet can be provided, for example also on two sides of the mandrel 4.

Figure 3:
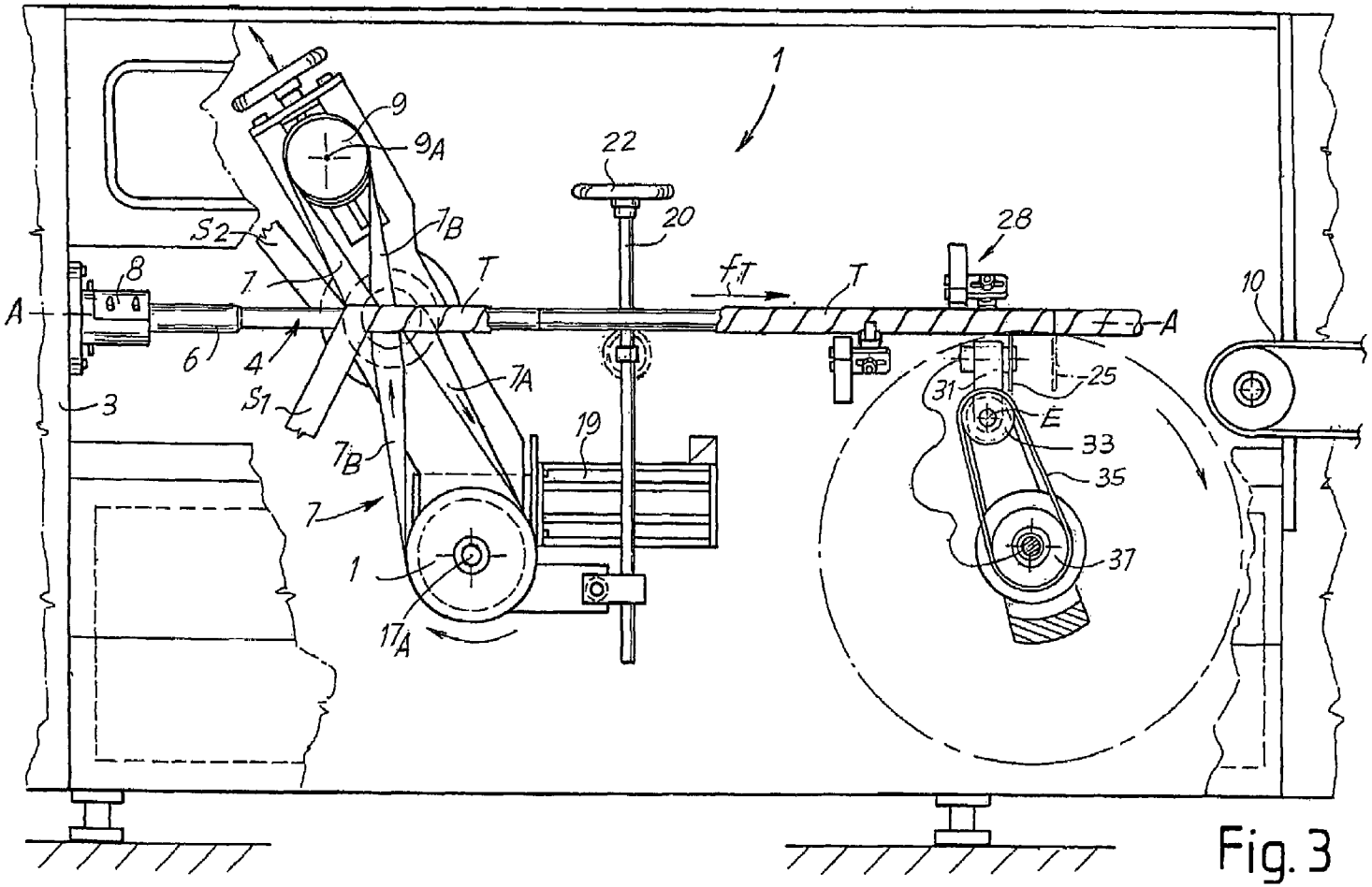
FIG. 3 shows a side view of a corewinder in a second embodiment of the invention.

As is shown in FIG. 2, as the cutter 25 is carried with its axis of rotation D in a fixed position with respect to the arm 25, the plane identified by its edge will not always be orthogonal to the axis of the mandrel 4. To correct this defect in parallelism between the axis D and the axis A, the cutter 25 may be mounted on a support oscillating or rotating on the arm 23, in a way coordinated with the rotational movement of said arm. For this purpose an actuator may be mounted on the arm 23 to actuate a support of the cutter 25 oscillating around an axis parallel to the axis B. Otherwise, as shown in the example in FIG. 3, a support 31 rotating about an axis E carried by the arm 23 and parallel to the axis B may be provided. Integral with the support 31 is a toothed wheel 33 coaxial with the axis D, around which a toothed belt 35 runs, which in turn runs around a second fixed toothed wheel 37 coaxial with the axis B of rotation of the arm 23. In this way when the arm 23 rotates about the axis B, as well as rotating about the axis D (cutting motion) the cutter 25 also moves in space according to a trajectory that is the combination of the motion about the axis B and about the axis E. By choosing the dimension of the various mechanical members appropriately the axis D of the cutter may be maintained parallel with respect to the axis A of the mandrel during cutting. If the pulleys 33 and 37 have the same diameter, the axis D remains parallel to the axis A of the mandrel 4 at all times.

When the motion of the support 31 about the axis E is supplied by an independent actuator, the arm 23 may be provided with a rotational motion that is not a continuous rotational motion, but an alternate rotational motion, as the cutter 25 may be taken to the reversed position during the return travel to prevent interference with the tube being formed. If the motion is continuous, or in any case always in the same direction, as mentioned hereinbefore it is possible to modulate the angular speed of the arm 23, to obtain the desired length of individual products M produced from cutting the tube T. In fact, to obtain this the rotation speed of the arm may be decreased or increased when the cutter is not operating.

Moreover, to adapt the machine to different diameters of the mandrel 4 and therefore of the tube T being formed, the distance between the axis A of the mandrel 4 and the axis B of rotation of the arm 23 may advantageously be adjustable.

It is understood that the drawing merely shows a practical embodiment of the invention, which may vary in forms and layouts without however departing from the scope of the concept on which the invention is based. Any reference numerals in the appended claims are provided purely to facilitate reading in the light of the description hereinbefore and of the accompanying drawings, and do not limit the scope of protection whatsoever.

The invention claimed is:

1. A machine for producing a tubular product by helical winding of strips of web material, comprising a mandrel, a winding member arranged to helically wind strips of web material about said mandrel and form a continuous tube; and a rotating disk-shaped cutter arranged to cooperate with said mandrel to cut the continuous tube into individual tubular products, wherein said disk-shaped cutter is carried by a rotating arm, and wherein said mandrel has a first section with a cross-section of a first diameter in an area where said cutter contacts the continuous tube being formed about said mandrel, a second section with a cross-section of a second diameter upstream of said first section, and a third section with a cross-section of a third diameter downstream of said first section, wherein said first diameter is narrower than each of the second diameter and the third diameter, the second diameter and the third diameter each corresponding to an inner diameter of the continuous tube formed about said mandrel.

2. The machine as claimed in claim 1, wherein said arm is arranged to rotate about an axis positioned at 90° with respect to an axis of the mandrel and skew with respect thereto.

3. The machine as claimed in claim 1 or 2, wherein said arm always rotates in one direction.

4. The machine as claimed in claim 1, wherein rotation speed of said arm is controlled so that advance speed of the cutter is approximately equal to advance speed of the continuous tube along said mandrel during cutting.

5. The machine as claimed in claim 4, wherein the rotation speed of the arm is adjustable as a function of length of tubular products to be formed upon cutting the continuous tube.

6. The machine as claimed in claim 1, wherein trajectory of the cutter with respect to the continuous tube formed about said mandrel is such that the cutter engages the continuous tube for an arc of rotation of the arm, during which the continuous tube performs at least one complete rotation about an axis of the mandrel.

7. The machine as claimed in claim 6, wherein the cutter is constructed and arranged to have an axis of rotation, when in contact with the continuous tube about the mandrel, which is maintained approximately parallel to the axis of the mandrel.

8. The machine as claimed in claim 6, wherein the cutter is constructed and arranged to have an axis of rotation, when in contact with the continuous tube about the mandrel, which forms an angle no greater than 10° with the axis of the mandrel.

9. The machine as claimed in claim 1, wherein said cutter is motorized.

10. The machine as claimed in claim 9, wherein said cutter is motorized by a pneumatic motor.

11. The machine as claimed in claim 1, wherein said cutter has an axis of rotation which is essentially fixed with respect to the rotating arm.

12. The machine as claimed in claim 1, wherein the cutter has an axis of rotation which is oscillating or rotating with respect to said rotating arm so that during engagement of the cutter with the continuous tube, the axis of rotation of the cutter is maintained essentially parallel to an axis of the mandrel.

13. The machine as claimed in claim 12, wherein the cutter is carried by a support rotating about an axis essentially parallel to an axis of rotation of said arm.

14. The machine as claimed in claim 1, further comprising a support for the mandrel arranged to supply a reaction force against stress applied by said cutter on said mandrel.

15. The machine as claimed in claim 1, wherein said cutter has a toothed cutting edge.

16. The machine as claimed in claim 1, wherein said rotating arm rotates about an axis, distance of which with respect to an axis of the mandrel, is adjustable.

* * * * *